US007397433B2

(12) United States Patent
Han et al.

(10) Patent No.: US 7,397,433 B2
(45) Date of Patent: Jul. 8, 2008

(54) BUILT-IN ANTENNA MODULE OF WIRELESS COMMUNICATION TERMINAL

(75) Inventors: Sun Kyu Han, Kyungki-do (KR); Wook Hee Lee, Kyungki-do (KR)

(73) Assignee: Samsung Electro-Mechanics Co. Ltd., Kyungki-Do (KR)

( * ) Notice: Subject to any disclaimer, the term of this patent is extended or adjusted under 35 U.S.C. 154(b) by 100 days.

(21) Appl. No.: 11/430,105

(22) Filed: May 9, 2006

(65) Prior Publication Data

US 2006/0256020 A1 Nov. 16, 2006

(30) Foreign Application Priority Data

May 10, 2005 (KR) ..... 10-2005-0039044

(51) Int. Cl.
*H01Q 1/24* (2006.01)
*H01Q 1/38* (2006.01)

(52) U.S. Cl. ..... 343/702; 343/700 MS

(58) Field of Classification Search ..... 343/702, 343/700 MS, 840

See application file for complete search history.

(56) References Cited

U.S. PATENT DOCUMENTS

2006/0152417 A1 * 7/2006 Ying et al. ..... 343/702

FOREIGN PATENT DOCUMENTS

KR 2006-43703 5/2006

OTHER PUBLICATIONS

Korean Intellectual Property Office, Office Action, mailed Aug. 17, 2006.

* cited by examiner

*Primary Examiner*—Shih-Chao Chen
(74) *Attorney, Agent, or Firm*—Lowe Hauptman Ham & Berner

(57) ABSTRACT

The invention relates to a built-in antenna module for a wireless communication terminal. The module includes at least one radiator. The module also includes a base having an inner space, disposed on a board of a terminal body, and having the radiator on an outer surface thereof to enable electric connection between an end of the radiator and the board of the terminal body. The module further includes an operator disposed in the inner space of the base for indicating an incoming call when power is supplied. The invention efficiently utilizes a limited space in the terminal body with enhanced capabilities of the antenna.

21 Claims, 8 Drawing Sheets

(a)

(b)

(a)

(b)

(c)

BUILT-IN ANTENNA MODULE OF WIRELESS COMMUNICATION TERMINAL

CLAIM OF PRIORITY

This application claims the benefit of Korean Patent Application No. 2005-39044 filed on May 10, 2005, in the Korean Intellectual Property Office, the disclosure of which is incorporated herein by reference.

BACKGROUND OF THE INVENTION

1. Field of the Invention

The present invention relates to an antenna installed inside a wireless communication terminal, and more particularly, a built-in antenna module for a wireless communication terminal, in which an operator for generating sounds or vibrations indicating an incoming call is housed in a component, thereby efficiently utilizing a limited space in a miniaturized wireless communication terminal.

2. Description of the Related Art

In general, a wireless communication terminal refers to a portable communication device capable of transmitting and receiving voices and texts and image data through wireless communication. The examples include a personal communication service (PCS) terminal, a Personal Digital Assistant (PDA), a smart phone, a next-generation mobile communication (IMT-2000) terminal, a wireless LAN terminal and the like.

The wireless communication terminal adopts a helical antenna or a dipole antenna to enhance its transmission and reception sensitivity. These are external antennas, which thus are extended out of the wireless terminal.

The external antennas have an advantage of non-directional radiation characteristics. But as they are extended to the outside, they are much likely to be damaged by external force, inconvenient for carrying around, and may be a hindrance to attractive exterior design of the terminal.

To overcome such a problem, plate-shaped built-in antennas such as a micro-strip patch antenna or inverted F-type antenna are adopted in the wireless communication terminal recently since they can be installed in the terminal without being extended outward.

FIG. 1 is an assembly diagram in which a built-in antenna and an actuator are provided in a wireless communication terminal according to the prior art. As shown, an antenna module 2 is hooked detachably onto a board 1 of a terminal body (not shown).

The antenna module 2 includes a buttress 3 having a plurality of fastening legs 3*a* corresponding to fastening grooves 1*a* formed on the board 1, a conductor 4 shaped like a metal plate on an upper surface of the buttress 3, and a feeder 5 extended from the conductor 4 to be inserted into a contact hole 1*b*.

Installation of such an antenna module 2 in a terminal body allows more attractive exterior of the terminal with greater portability. In a miniaturized terminal, however, in order to retain or enhance the current transmission and reception efficiency and frequency reception capabilities, the size of the installation area of the antenna prior to miniaturization needs to be maintained or increased.

However, with the limited space in the miniaturized terminal body, it is difficult to maintain or increase the installation area of the antenna.

Furthermore, a part of the board 1 needs to be preserved for disposing an actuator such as a vibration motor 12 for generating vibrations or a speaker 11 for generating sounds indicating an incoming call. Thus, in case of disposing the antenna module 2 coplanar with the actuator 10, there is a limitation in increasing the space for the antenna module to enhance the capabilities of the antenna.

SUMMARY OF THE INVENTION

The present invention has been made to solve the foregoing problems of the prior art and it is therefore an object of the present invention to provide a built-in antenna module which efficiently utilizes a limited space in a terminal body with improved capabilities of an antenna.

According to an aspect of the invention for realizing the object, there is provided a built-in antenna module for a wireless communication terminal including:

at least one radiator;

a base having an inner space, disposed on a board of a terminal body, and the base having the radiator on an outer surface thereof to enable electric connection between an end of the radiator and the board of the terminal body; and an operator disposed in the inner space of the base for indicating an incoming call when power is supplied.

Preferably, the radiator has the same dimensions as the upper surface of the base in order to maximize transmission and reception capability of the antenna.

Preferably, the radiator is a plate-shaped antenna pattern assembled detachably onto the outer surface of the base.

Preferably, a resilient terminal is extended in a predetermined length from an end of the radiator to a lower surface of the base.

Preferably, the radiator is an antenna pattern printed on an outer surface of the base.

Preferably, the base includes an upper base and a lower base assembled together to form an inner space therein for internally housing the operator.

More preferably, the upper base has a plurality of insertion projections on an upper surface thereof corresponding to insertion holes of the radiator.

More preferably, the upper base has a plurality of vertical pillars on an undersurface thereof corresponding to a plurality of lower holes formed in the upper surface of the lower base.

More preferably, the upper base has at least one insertion flap on an outer periphery thereof corresponding to insertion grooves formed on an outer periphery of the lower base.

More preferably, the built-in antenna module further includes a gasket between the upper base and the lower base for preventing sounds generated by the operator from leaking out of the base.

More preferably, the upper base and the lower base are bonded integrally with an adhesive to prevent sounds generated by the operator from leaking out of the base.

More preferably, the upper base and the lower base are bonded integrally via ultrasonic welding to prevent sounds generated by the operator from leaking out of the base.

More preferably, one of the upper and lower bases includes a seating part depressed for precisely locating the operator.

More preferably, the seating part has a predetermined dimension of sound emitting opening, and one of the upper and lower bases comprises a sound passageway having an opening at an end facing a receiver to deliver the sound emitted from the sound emitting opening to the receiver of the terminal body.

More preferably, the lower base has a plurality of projections corresponding to holes formed in the board.

Preferably, the base is fastened with a fastening member such that the lower surface of the base is in surface contact with the upper surface of the board.

Preferably, the base is made of insulation material.

Preferably, the operator has at least one multi-actuator for selectively generating sounds or vibrations when power is supplied.

More preferably, one of the upper and lower bases corresponding to the multi-actuator has an opening for delivering the generated sounds to a receiver of the terminal body.

Preferably, the operator includes at least one first actuator for generating sounds when power is supplied and at least one second actuator for generating vibrations when power is supplied.

More preferably, one of the upper and lower bases corresponding to the first actuator has an opening for delivering the generated sounds to a receiver of the terminal body.

More preferably, one of the upper and lower bases corresponding to the second actuator is sealed to deliver the generated vibrations through the base to the terminal body.

More preferably, the lower base with the second actuator disposed therein comprises a plurality of vertical ribs in contact with an outer surface of the second actuator.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENT

Preferred embodiments of the present invention will now be described in detail with reference to the accompanying drawings.

As shown in FIGS. 2 to 6, in an antenna module 100 of the present invention, an antenna component for transmitting and receiving an electrical wave is integrated with a component for generating sounds or vibrations indicating an incoming call, thereby efficiently utilizing an inner space of the wireless communication terminal. The antenna module 100 includes a radiator 110, a base 120 and an operator 130.

The radiator 110 is composed of at least one conductor disposed on an outer surface of the base 120. During a telephonic communication, the radiator 110 receives an electric signal from a board M provided in the terminal body, transforming the signal into an electrical wave to be radiated to the outside while receiving an electrical wave in a particular frequency band transmitted from the outside.

Figure 1:
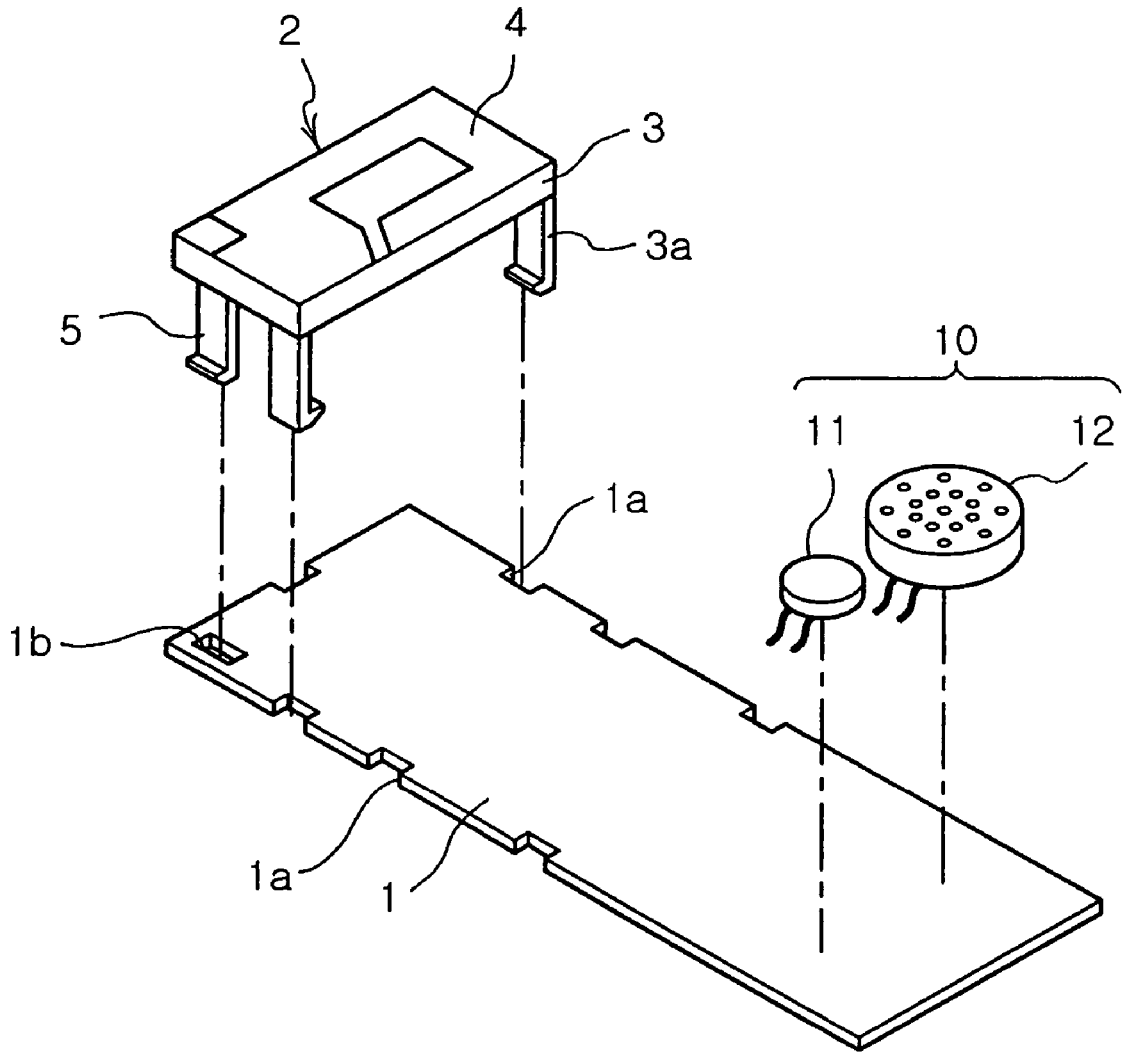
PRIOR ART FIG. 1
FIG. 1 illustrates assembly of a built-in antenna and an actuator provided in a terminal according to the prior art.
Figure 2:
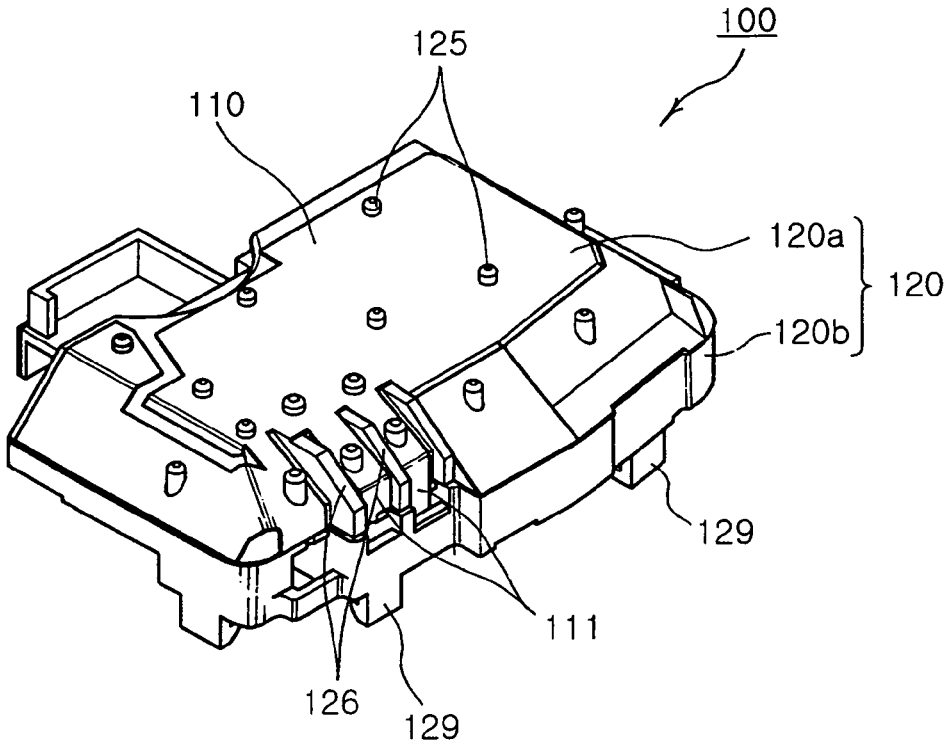
FIG. 2 illustrates a built-in antenna module for a wireless communication terminal according to a first embodiment of the present invention, in which (a) is a top perspective view, and (b) is a bottom perspective view.
Figure 2:
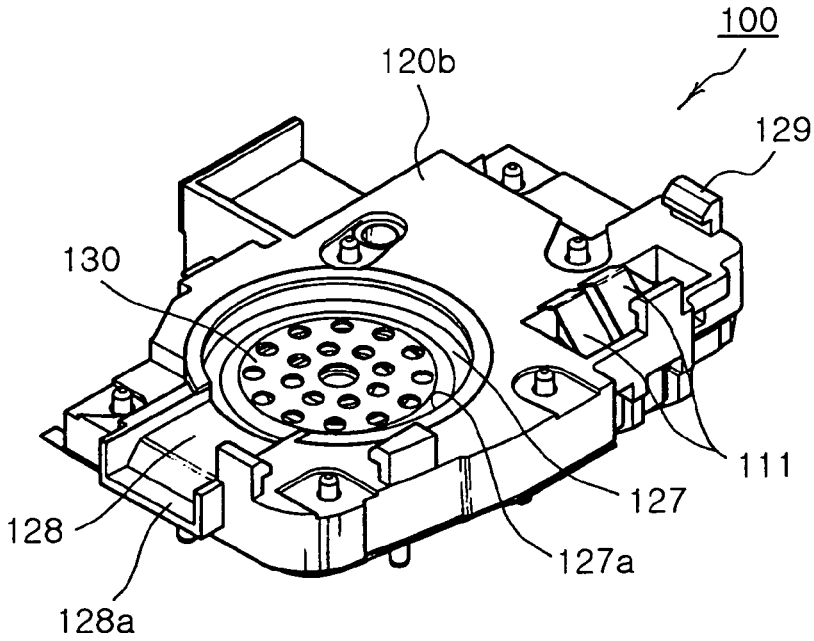

In addition, as shown in FIG. 2(*a*), it is preferable that the radiator 110 is formed in substantially the same dimensions as the upper surface of the base 120 in order to maximize the transmission and reception capabilities of the antenna.

Such a radiator 110 may be a plate-shaped antenna pattern detachably assembled onto an outer surface of the base 120 with a plurality of projections 125 formed on an outer surface of the base inserted into a plurality of holes 115 formed in the radiator, but is not limited to such and can be varied depending on the designing of the pattern.

As shown in FIG. 2(*c*), an end of the radiator 110 is extended in a predetermined length to the lower surface of the base 120 to integrally form at least one resilient terminal. The resilient terminal 111 becomes electrically connected to a pattern circuit formed on the board M of the terminal body 101 as the radiator 110 and the base 120 are assembled together.

Here, it is preferable that the radiator 110 adopts a plate-shaped antenna such as a micro-strip patch antenna or inverted F-type antenna.

The radiator 110 may be an antenna pattern printed on an outer surface of the base 110 to be electrically connected with the pattern circuit of the board.

In addition, the base 120 is a structure made of insulation material and detachably assembled onto the board M such that the resilient terminal 111 extended from an end of the radiator 110 is electrically connected with the board M of the terminal body 101.

As shown in FIGS. 2(*a*) and (*b*) to 5(*a*) and (*b*), the base 120 is composed of an upper base 120*a* and a lower base 120*b* assembled together to provide a space for internally housing an operator which generates sounds or vibrations indicating an incoming call when power is supplied.

The upper base 120*a* has a plurality of projections 125 on an upper surface thereof inserted into a plurality of holes 115 formed in the radiator 110. Also, the upper base 120*a* has a plurality of vertical pillars 121 protruded from a lower surface thereof inserted into a plurality of lower holes 123 formed on an upper surface of the lower base 120*b*.

The upper base 120*a* has at least one insertion flap 122 on an outer surface thereof inserted into insertion grooves 124 formed on an outer surface of the lower base 120*b*. The insertion flaps 122 and the insertion grooves 124 form a structure that determines an angle and direction of terminals 131*a* and 132*a* as well as providing protection for the terminals 131*a* and 132*a* as the terminals 131*a* and 132*a* are drawn to the outside.

The upper and lower bases 120*a* and 120*b* are easily assembled together via one-to-one assembly of the vertical pillars 121 and the lower holes 123, and form a predetermined dimension of space therebetween for housing the operator 130.

Here, a gasket 120*c* made of rubber may be provided between the upper and lower bases 120*a* and 120*b* to prevent the sounds generated by the operator 130 from leaking out of the base, but the present invention is not limited to such. The upper and lower bases 120*a* and 120*b* can be integrally bonded by an adhesive or via ultrasonic welding.

In addition, at least one guide rib 126 can be protruded from one side of an upper surface of the upper base 120*a* such that the resilient terminals 111 extended from an end of an upper surface of the upper base 120*a* are in alignment therewith.

In addition, in order to precisely locate the operator 130, a seating part 127 is depressed in a predetermined depth on an upper surface or a lower surface of the base 120 corresponding to an upper surface or a lower surface of the operator 130. Such a seating part 127 has a predetermined dimension of sound emitting opening 127*a* so that the sounds generated from the operator 130 are emitted to the board M and delivered without any loss through a receiver 108 disposed on a side of the terminal body 101 to the outside.

Here, it is preferable that the inner circumference of the sound emitting opening 127*a* is larger than the outer circumference of the operator 130, preventing the operator 130 from slipping downward.

In addition, in case of forming the sound emitting opening 127*a* in a lower surface of the lower base 120*b*, it is preferable that the lower base 120*b* has a sound passageway 128 having an opening 128*a* on an end facing the receiver 108 in order to facilitate delivery of the sounds emitted from the sound emitting opening 127*a* to the receiver of the terminal body 101. The same can be applied to a sound emitting opening formed in the upper base 120*a*.

With the above configuration, the sounds generated from the operator 130 pass through the sound emitting opening 127*a* and the sound passageway 128 and through the receiver 108 of the terminal body 101 to the outside, and finally are perceived by the user.

Also, the lower base 120*b* has a plurality of assembly hooks 129 on an undersurface thereof corresponding to a plurality of assembly holes 109 perforated through an upper surface of the board M to facilitate assembly of the lower base with the board.

With the operator 130 disposed in the inner space of the base 120 composed of the upper and lower bases 120*a* and 120*b* assembled together, the assembly hook 129 is vertically aligned with the assembly hole 109 of the board M. Then the base 120 is pressured against the board M such that the end of the assembly hook 129 is resiliently inserted into the assembly hole 109 and hooked inside the assembly hole 109, thereby assembling the base 120 with the operator 130 disposed therein onto the upper surface of the board M.

Here, with the undersurface of the base 120 in surface contact with the upper surface of the board, the resilient terminal 111 for transmission and reception of the radiator 110 is aligned by the guide rib 126 formed in a side of the upper surface of the upper base 120*a*, and has the lower end thereof in resilient contact with the pattern circuit of the board M.

The base 120 can be assembled onto the board M with the assembly of the assembly hooks 129 of the lower base 120*b* into the assembly holes 109 of the board M but the present invention is not limited to such.

It is also desirable that the base 120 has screw holes (not shown) corresponding to another set of screw holes (not shown) of the board M so that the base 120 have surface contact with the board M by a plurality of fastening members inserted and connecting through the screw holes facing each other.

Thus, the operator 130 generates vibrations indicating an incoming call which vibrate the base 120 and also the board M in surface contact with the base 120, thereby vibrating the entire terminal body 101.

Figure 3:
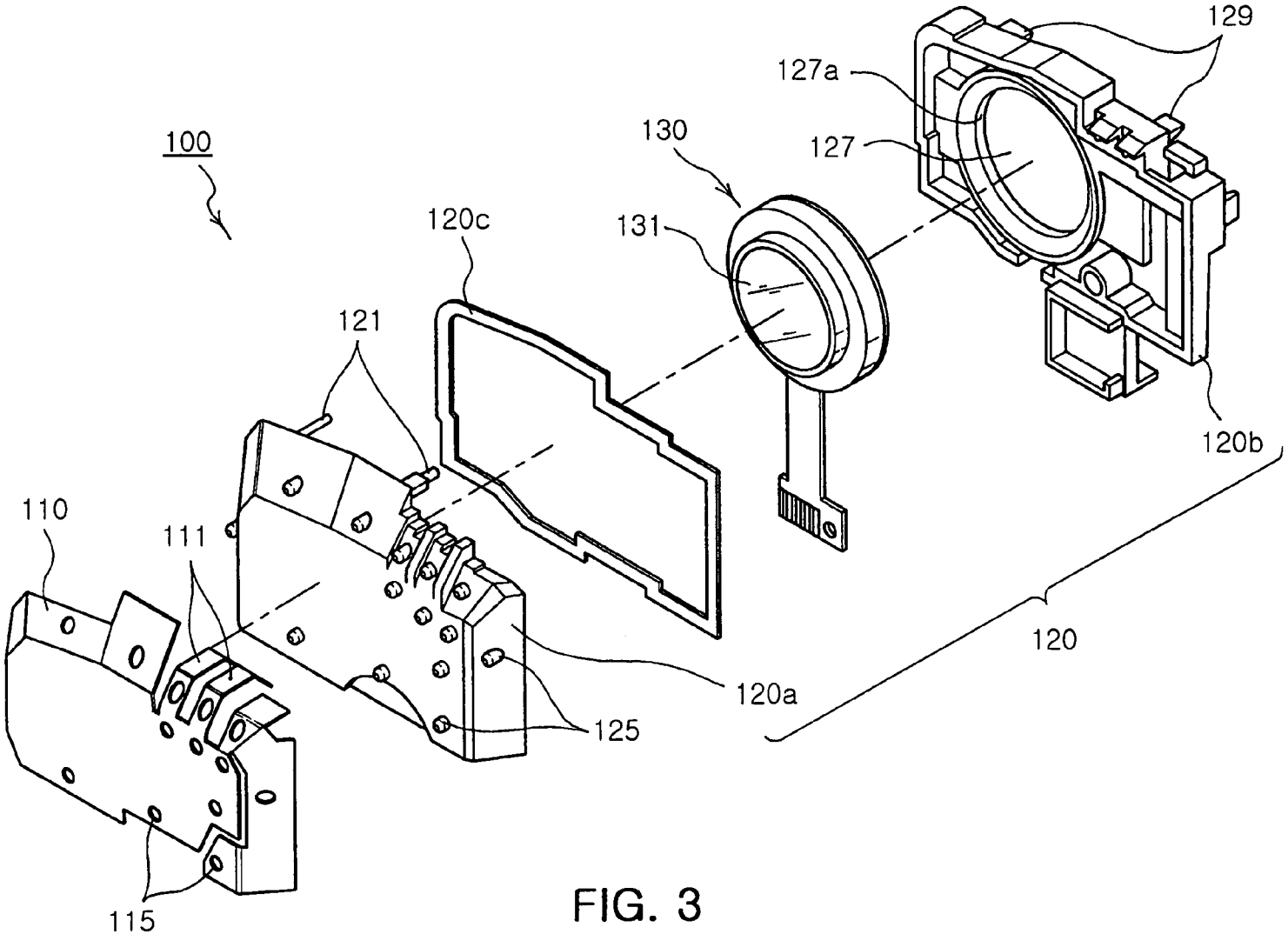
FIG. 3 is an exploded perspective view illustrating the built-in antenna for the wireless communication terminal according to the first embodiment of the present invention.
Figure 4:
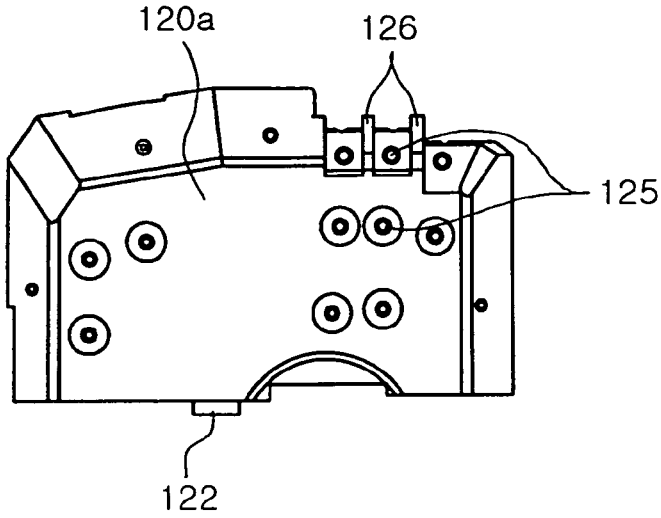
FIG. 4 illustrates an upper base adopted in the built-in antenna for the wireless communication terminal according to the first embodiment of the present invention, in which (a) is a plan view, (b) is a front view, and (c) is a side view.
Figure 4:
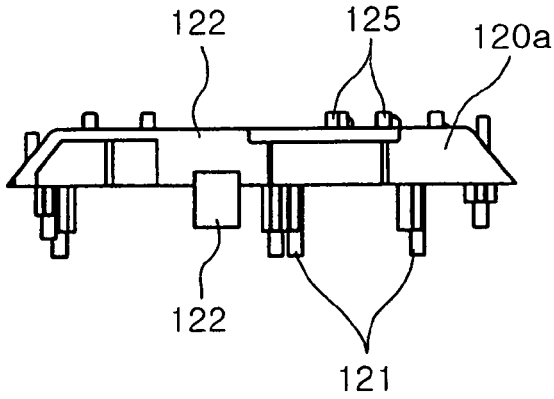
Figure 4:
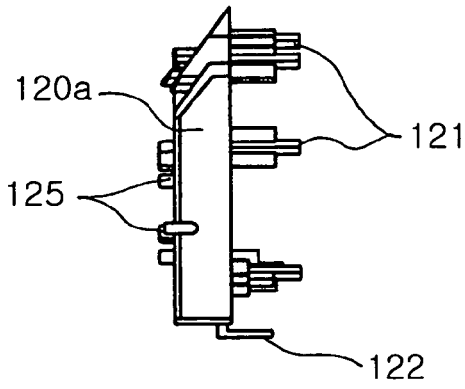
Figure 5:
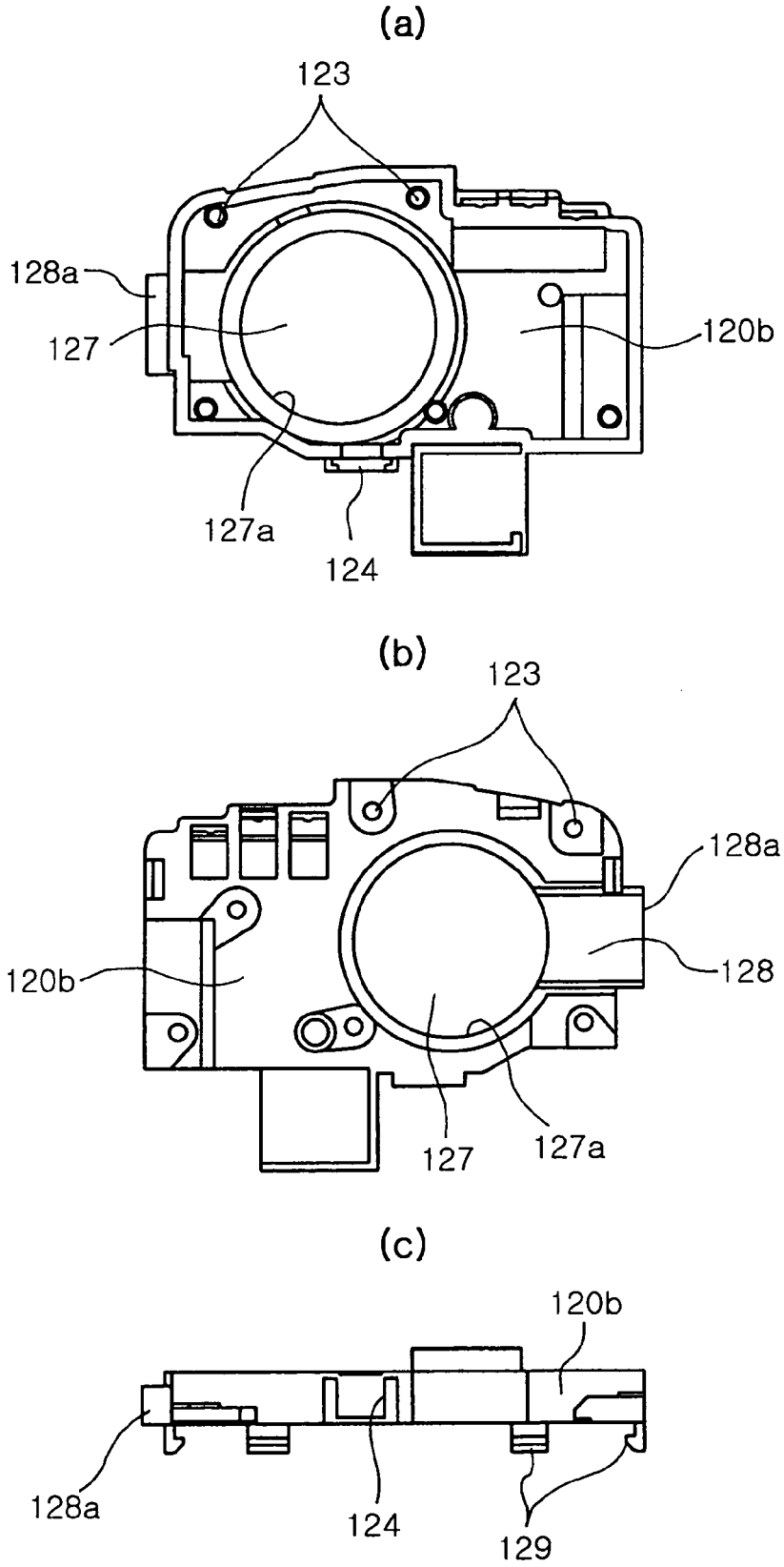
FIG. 5 illustrates a lower base adopted in the built-in antenna for the wireless communication terminal according to the first embodiment of the present invention, in which (a) is a plan view, (b) is a bottom view, and (c) is a front view.
Figure 6:
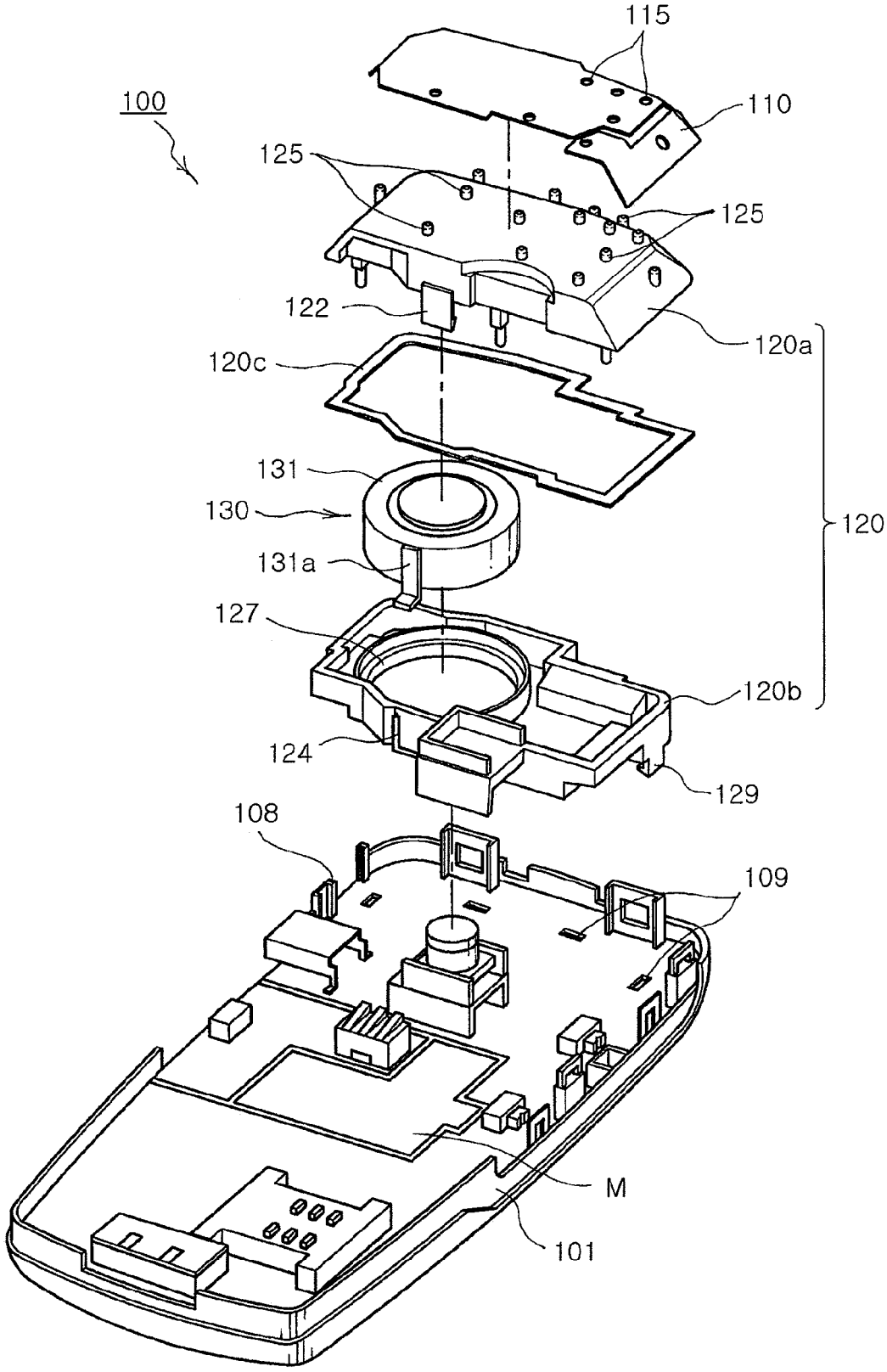
FIG. 6 illustrates the assembly flow of the built-in antenna for the wireless communication terminal according to the first embodiment of the present invention.

In the meantime, as shown in FIGS. 3 and 6, the operator 130 is composed of at least one operating means disposed in the inner space of the base 120, generating sounds or vibrations indicating an incoming call.

The operator 130 is composed of at least one multi-actuator 131 selectively generating sounds or vibrations depending on the choice of the user when power is supplied through a terminal 131*a* extended outward and connected with a feeder (not shown) of the board M.

It is preferable that the upper or lower surface of the base 120 corresponding to the upper or lower surface of the multi-actuator 131 has an opening so that the generated sounds are delivered through the opening to the receiver 108 of the terminal body 101.

In addition, as shown in FIGS. 3 and 6, the terminal 131*a* of the multi-actuator 131 may be a flexible board having a connector extended laterally and electrically connected with the pattern circuit of the board M to supply power to the multi-actuator 131. Alternatively, the terminal 131*a* of the multi-actuator 131 may be a lead electrically solder-connected with the pattern circuit of the board M to supply power to the multi-actuator 131.

Figure 7:
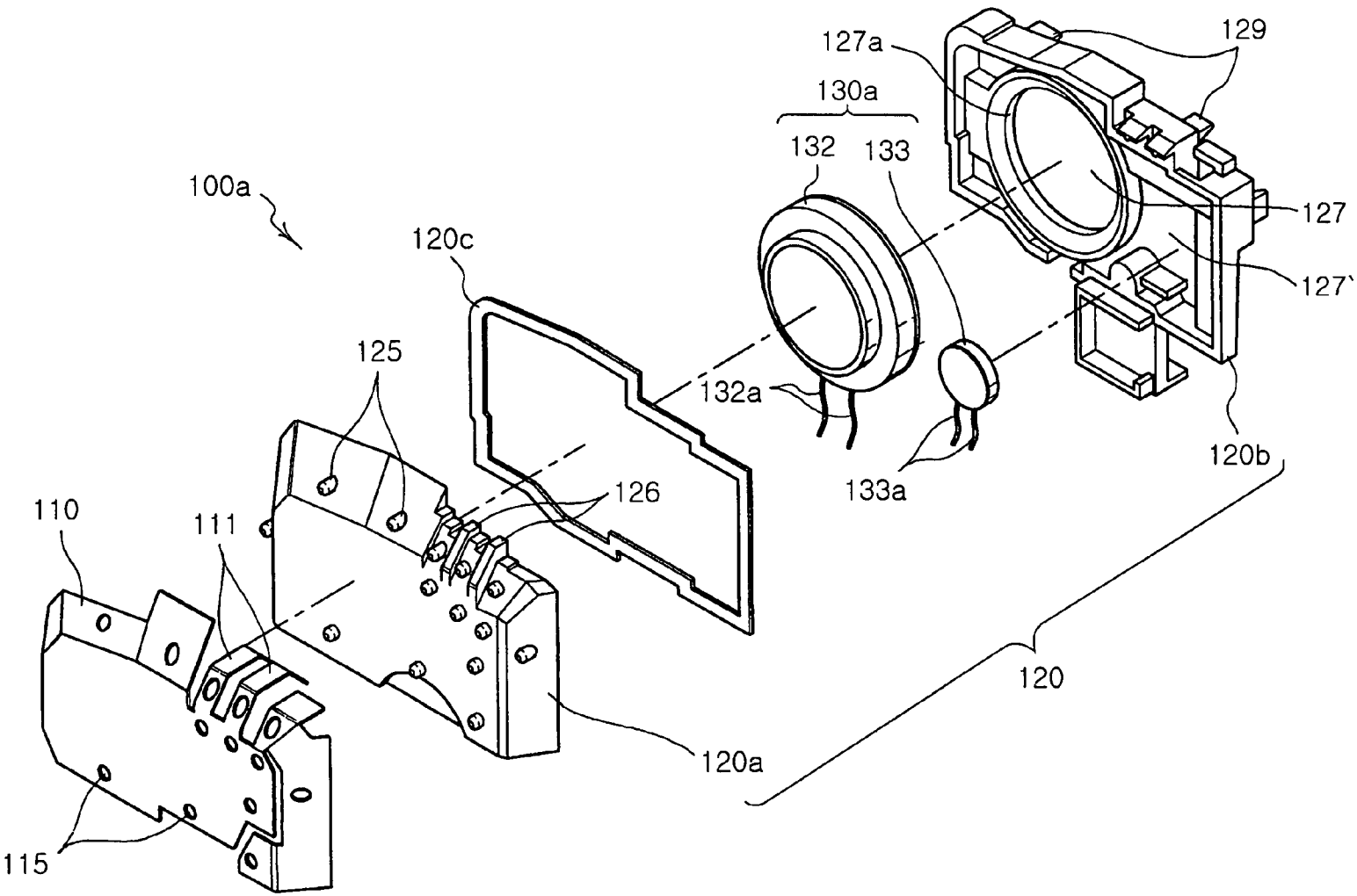
FIG. 7 is an exploded perspective view illustrating a built-in antenna for a wireless communication terminal according to a second embodiment of the present invention.
Figure 8:
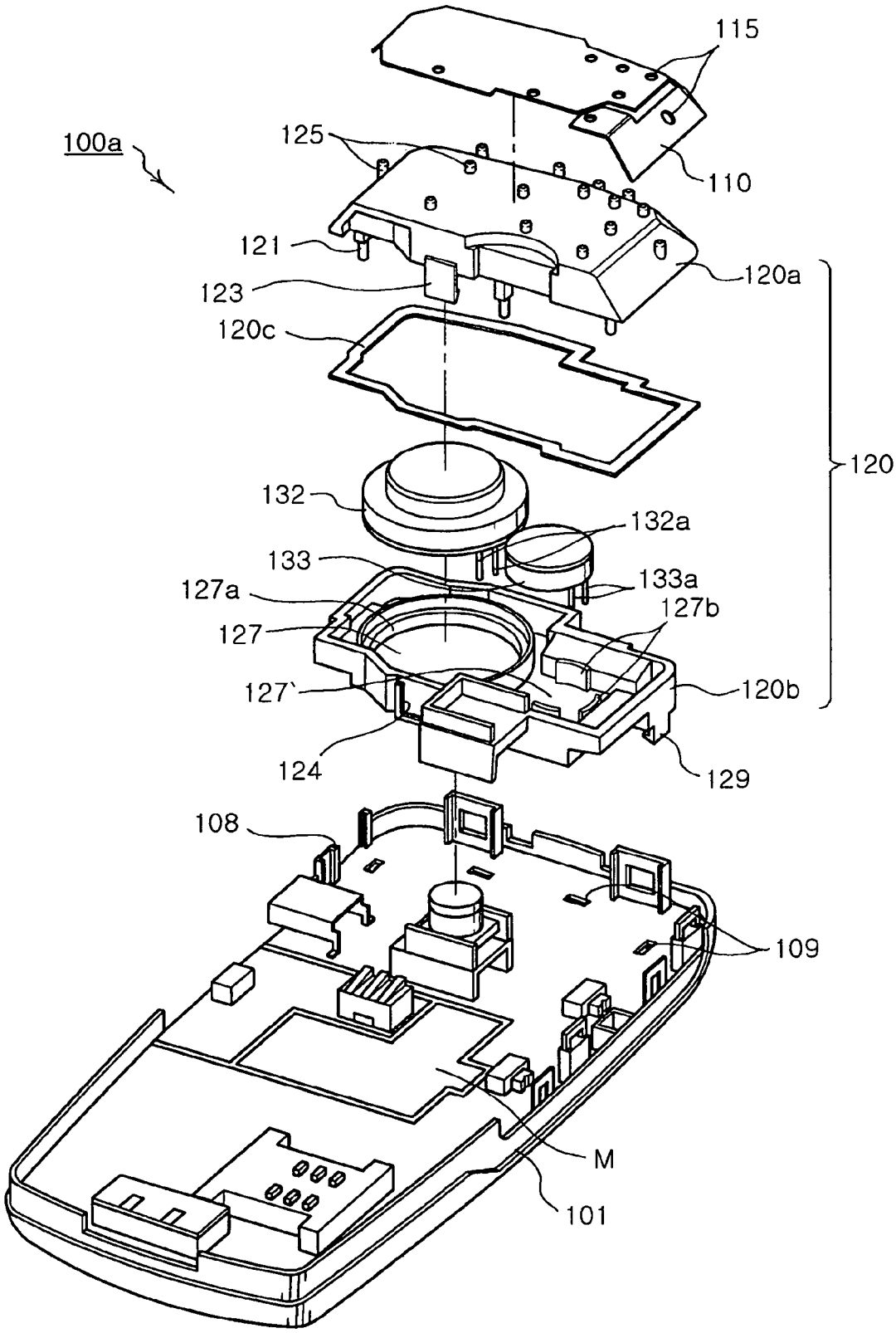
FIG. 8 illustrates the assembly flow of the built-in antenna for the wireless communicative terminal according to the second embodiment of the present invention.

FIG. 7 is an exploded perspective view illustrating a built-in antenna for a wireless communication terminal according to a second embodiment of the present invention, and FIG. 8 illustrates assembly of a built-in antenna for a wireless communication terminal according to a second embodiment of the present invention.

The built-in antenna module 100*a* according to the invention includes a radiator 110, a base 120 and an operator 130*a*, and the same components are denoted by the same reference numerals with the detailed explanation thereof omitted.

As shown in FIGS. 7 and 8, the operator 130*a* disposed in the inner space of the base 120 is consisted of at least one first actuator 132 for generating sounds when power is supplied and at least one second actuator 133 generating vibrations when power is supplied.

Here, it is preferable that a seating part 127 formed on the upper or lower surface of the base 120 corresponding to the upper or lower surface of the first actuator 132 has an opening so that the generated sounds are delivered through the opening to a receiver of a terminal body 101. It is also preferable that another seating part 127' formed on the upper or lower surface of the base 120 corresponding to the upper or lower surface of the second actuator 133 is sealed so that the generated vibrations are transmitted through the base 120 to the terminal body 101.

In addition, it is preferable that the seating part 127' with the second actuator 133 disposed therein has a plurality of vertical ribs 127*b* protruded therefrom which are in resilient contact with the outer surface of the second actuator 133 so that the second actuator 133 is disposed in the exact position without wobbling.

In addition, as shown in FIGS. 7 and 8, terminals 132*a* and 133*a* of the first and second actuators 132 and 133 may be leads extended laterally from the actuators 132 and 133 disposed on the upper surface of the lower base 120*b* and electrically solder-connected to the pattern circuit of the board M to supply power, or may be a flexible board having a connector.

The assembly procedures of the built-in antenna module 100, 100*a* are shown in FIGS. 6 and 8. First, the operator 130 is disposed in the seating part 127 formed on the upper surface of the lower base 120*b*.

In case of the operator 130 composed of one multi-actuator 131 selectively generating sounds and vibrations when power is supplied, the multi-actuator 131 is disposed in the seating part 127 having an opening for forming a sound emitting opening 127*a*, in an upper part of the lower base 120*b*.

The terminal 131*a* extended from the multi-actuator 131 is drawn out through the sound emitting opening 127*a* or a terminal hole (not shown) perforated in the seating part 127 and through the lower part of the lower base 120*b* to the outside.

In addition, in case of the operator 130 composed of the first actuator for generating sounds when power is supplied and the second actuator 133 for generating vibrations when power is supplied, the first actuator 132 is disposed in the seating part 127 having an opening for forming a sound emitting opening 127*a* in an upper part of the lower base 120*b*, and the second actuator 133 is disposed in another seating part 127' with the sealed floor surface of the lower base 120*b*.

In addition, each of the terminals 132*a* and 133*a* extended from the first and second actuators 132 and 133 is extended through the sound emitting opening 127*a* or the terminal hole (not shown), out of the lower base 120*b*.

Thereafter, with the upper base 120*a* vertically aligned on top of the lower base 120*b* having the operator 130 disposed thereon, the vertical pillars 121 of the upper base 120*a* are assembled one-to-one with the lower holes 123 of the lower base 120*b*, thereby assembling the upper and lower bases 120*a* and 120*b* together.

Thereby, the operator 130 is internally housed in the inner space formed by the upper and lower bases 120*a* and 120*b* assembled together.

In addition, the projections 125 of the upper base 120*a* is inserted into the holes 115 formed in the radiator 110 one-to-one, so that the radiator 110 is integrally assembled onto the upper surface of the upper base 120*a*.

At this point, the resilient terminal 111 for transmission and reception extended from an end of the radiator 110 is fitted in between the guide ribs 126 provided on one side of the upper surface of the upper base 120*a*, and the end of the resilient terminal 111 is extended in a predetermined length through an outlet formed in the lower base 120*b*, out of the undersurface of the lower base 120*b*.

The plurality of assembly hooks 129 protruded from the undersurface of the lower base 120*b* are inserted one-to-one into the assembly holes 109 of the board M, so that the base 120 having the operator 130 therein comes in surface contact with the upper surface of the board M, and simultaneously, the resilient terminal 111 becomes electrically connected to the pattern circuit of the board M.

In addition, each of the terminals 131*a*, 132*a*, and 133*a* of the operator 130 drawn out of the lower part of the base 120 is electrically connected with the pattern circuit of the board M, allowing the operator 130 to generate sounds or vibrations when power is supplied. The sounds generated at this point are delivered to the outside through the receiver 108 of the terminal body 101, and the vibrations are transmitted through the base 120 to the terminal body 101, vibrating the entire terminal.

According to the invention set forth above, a base having a radiator thereon has an inner space for internally housing an operator for selectively and individually generating sounds or vibrations to integrate the radiator and the operator in a module, efficiently utilizing the constrained inner space of the terminal body, thereby allowing further miniaturization of the terminal without weakening the transmission and reception capabilities of an antenna.

While the present invention has been shown and described in connection with the preferred embodiments, it will be apparent to those skilled in the art that modifications and variations can be made without departing from the spirit and scope of the invention as defined by the appended claims.

What is claimed is:

1. A built-in antenna module for a wireless communication terminal comprising:

at least one radiator;

a base having an inner space, disposed on a board of a terminal body, and the base having the radiator on an outer surface thereof to enable electric connection between an end of the radiator and the board of the terminal body; and an operator disposed in the inner space of the base for indicating an incoming call when power is supplied;

wherein the base includes an upper base and a lower base assembled together to form an inner space therein for internally housing the operator; and wherein a gasket is disposed between the upper base and the lower base for preventing sounds generated by the operator from leaking out of the base.

2. The built-in antenna module for a wireless communication terminal according to claim 1, wherein the radiator has the same dimensions as the upper surface of the base in order to maximize transmission and reception capability of the antenna.

3. The built-in antenna module for a wireless communication terminal according to claim 1, wherein the radiator comprises a plate-shaped antenna pattern assembled detachably onto the outer surface of the base.

4. The built-in antenna module for a wireless communication terminal according to claim 1, wherein a resilient terminal is extended in a predetermined length from an end of the radiator to a lower surface of the base.

5. The built-in antenna module for a wireless communication terminal according to claim 1, wherein the radiator comprises an antenna pattern printed on an outer surface of the base.

6. The built-in antenna module for a wireless communication terminal according to claim 1, wherein the upper base comprises a plurality of insertion projections on an upper surface thereof corresponding to insertion holes of the radiator.

7. The built-in antenna module for a wireless communication terminal according to claim 1, wherein the upper base comprises a plurality of vertical pillars on an undersurface thereof corresponding to a plurality of lower holes formed in the upper surface of the lower base.

8. The built-in antenna module for a wireless communication terminal according to claim 1, wherein the upper base comprises at least one insertion flap on an outer periphery thereof corresponding to insertion grooves formed on an outer periphery of the lower base.

9. The built-in antenna module for a wireless communication terminal according to claim 1, wherein the upper base and the lower base are bonded integrally with an adhesive to prevent sounds generated by the operator from leaking out of the base.

10. The built-in antenna module for a wireless communication terminal according to claim 1, wherein the upper base and the lower base are bonded integrally via ultrasonic welding to prevent sounds generated by the operator from leaking out of the base.

11. The built-in antenna module for a wireless communication terminal according to claim 1, wherein one of the upper and lower bases comprises a seating part depressed for precisely locating the operator.

12. The built-in antenna module for a wireless communication terminal according to claim 11, wherein the seating part comprises a predetermined dimension of sound emitting opening, and one of the upper and lower bases comprises a sound passageway having an opening at an end facing a receiver to deliver the sound emitted from the sound emitting opening to the receiver of the terminal body.

13. The built-in antenna module according to claim 1, wherein the lower base comprises a plurality of projections corresponding to holes formed in the board.

14. The built-in antenna module according to claim 1, wherein the base is fastened with a fastening member such that the lower surface of the base is in surface contact with the upper surface of the board.

15. The built-in antenna module for a wireless communication terminal according to claim 1, wherein the base is made of insulation material.

16. The built-in antenna module for a wireless communication terminal according to claim 1, wherein the operator comprises at least one multi-actuator for selectively generating sounds or vibrations when power is supplied.

17. The built-in antenna module for a wireless communication terminal according to claim 16, wherein one of the upper and lower bases corresponding to the multi-actuator has an opening for delivering the generated sounds to a receiver of the terminal body.

18. The built-in antenna module for a wireless communication terminal according to claim 1, wherein the operator comprises at least one first actuator for generating sounds when power is supplied and at least one second actuator for generating vibrations when power is supplied.

19. The built-in antenna module for a wireless communication terminal according to claim 18, wherein one of the upper and lower bases corresponding to the first actuator has an opening for delivering the generated sounds to a receiver of the terminal body.

20. The built-in antenna module for a wireless communication terminal according to claim 18, wherein one of the upper and lower bases corresponding to the second actuator is sealed to deliver the generated vibrations through the base to the terminal body.

21. The built-in antenna module for a wireless communication terminal according to claim 18, wherein the lower base with the second actuator disposed therein comprises a plurality of vertical ribs in contact with an outer surface of the second actuator.

* * * * *